US005653026A

United States Patent [19]

Tezuka

[11] Patent Number: 5,653,026

[45] Date of Patent: Aug. 5, 1997

[54] ELECTRIC RAZOR OUTER BLADE ASSEMBLY ATTACHMENT STRUCTURE

[75] Inventor: Yoshitaka Tezuka, Tsuna-gun, Japan

[73] Assignee: Sanyo Electric Co., Ltd., Osaka, Japan

[21] Appl. No.: 546,525

[22] Filed: Oct. 20, 1995

[30] Foreign Application Priority Data

Oct. 31, 1994 [JP] Japan ..... 6-266645

[51] Int. Cl.[6] ..... B26B 19/04

[52] U.S. Cl. ..... 30/43.92; 30/43.9

[58] Field of Search ..... 30/43.92, 346.51, 30/43.6, 43.9

[56] References Cited

U.S. PATENT DOCUMENTS

| | | | |
|---|---|---|---|
| 4,604,801 | 8/1986 | Ullmann et al. | 30/43.92 |
| 4,837,929 | 6/1989 | Tanahashi et al. | 30/43.92 |
| 5,367,771 | 11/1994 | Mukai . | |

FOREIGN PATENT DOCUMENTS

| | | |
|---|---|---|
| 34 15 122 | 10/1985 | Germany . |
| 36 23 404 | 1/1988 | Germany . |

*Primary Examiner*—Douglas D. Watts

*Attorney, Agent, or Firm*—Wenderoth, Lind & Ponack

[57] ABSTRACT

The attachment structure has an outer blade assembly which mounts in a detachable manner on an outer blade frame and latch releases which disengage the outer blade assembly and outer blade frame. Latching pieces which latch into the outer blade frame are provided on the end planes of the outer blade assembly. Pressure arms project from both sides of the ends of the latching pieces. The latch releases have a plurality of push-out projections which push the latching piece pressure arms out of latching detents. The push-out projections extend in a direction that separates the outer blade assembly from the outer blade frame. The push-out projections apply pressure to pressure arms on both sides of each latching piece to disengage the latching pieces from the latching detents and separate the outer blade assembly from the outer blade frame.

12 Claims, 7 Drawing Sheets

ELECTRIC RAZOR OUTER BLADE ASSEMBLY ATTACHMENT STRUCTURE

BACKGROUND OF THE INVENTION

This invention relates to the outer blade attachment structure of an electric razor with a mesh blade outer blade assembly that mounts in a detachable manner in an outer blade frame which constitutes part of the razor case.

The outer blade assembly of an electric razor with curved-arched shaped sheet metal mesh outer blades connects to the outer blade frame in a detachable manner. This is to allow detachment of the outer blade assembly for whisker removal during cleaning. A detachable outer blade assembly and outer blade frame structure is described in Japanese Non-examined Patent Publication No. 5-309181 issued Nov. 22, 1993. Turning to FIGS. 1 and 2, the electric razor disclosed has an outer blade assembly 26 with two rows of outer blade units 21 which mount in a parallel fashion via links 22 in an outer blade case 23. The outer blade assembly 26 mounts in a detachable manner in an outer blade frame 24. Latching pieces 23A are provided on the outer blade case 23 to make the outer blade assembly 26 detachable. The latching pieces 23A project out, and extend downward from the ends of the outer blade case 23. The upper ends of the latching pieces 23A connect to the ends of the outer blade assembly 26 allowing the latching pieces to deform elastically. The outward projecting lower end of each latching piece 23A catches in latching detents 24B in the outer blade frame 24. When the outer blade assembly 26 is mounted in the outer blade frame 24, the latching pieces 23A are inserted in the concave latching detents 24B. In an electric razor with this type of outer blade assembly attachment structure, the latching pieces 23A catch in the latching detents 24B to keep the outer blade assembly 26 from inadvertently disconnecting from the outer blade frame 24.

Latch releases 25 are provided on the outer blade frame 24 to release the outer blade case 23 from the outer blade frame 24. The latch releases 25 are made from elastically deformable plastic. The lower ends of the latch releases 25 are fixed to the casing 28 of the electric razor. The latch releases 25 are disposed within the concave latching detents 24B of the outer blade frame 24 to allow the upper ends of the latch releases to push the latching pieces 23A out of the detents.

In this type of electric razor outer blade assembly attachment structure, the outer blade assembly 26 can be separated from the outer blade frame 24 by pressing the latch release 25 buttons. This is due to the upper ends of the latch releases 25 pushing the latching pieces 23A out of the outer blade frame 24 concave latching detents 24B. However, this structure has the disadvantage that the outer blade assembly 26 cannot be readily removed from the outer blade frame 24 when the two are solidly connected. Particularly since the outer blade case 23 is made of thin plastic, it is difficult to squeeze the latch release buttons and pull the outer blade assembly with sufficient force. The reason why the outer blade assembly 26 cannot be easily detached from the outer blade frame 24 is because when the latch releases 25 are pushed, the upper ends of the latch releases 25 push against the surfaces of the latching pieces 23A and the latching pieces 23A slide upward while being pushed. When the latching pieces 23A slide upward, pressure from the latch releases 25 has less effect and more force is required to continue removing the latching pieces 23A from the latching detents 24B. Smooth movement of the latch releases 25 and the latching pieces 23A is difficult when the latching pieces 23A slide upward under pressure.

The present invention was developed to solve these problems. It is thus a primary object of the present invention to provide an electric razor outer blade assembly attachment structure wherein the outer blade assembly can be reliably connected to the outer blade frame and can also be easily removed from the outer blade frame.

The above and further objects and features of the invention will more fully be apparent from the following detailed description with accompanying drawings.

SUMMARY OF THE INVENTION

The electric razor outer blade assembly attachment structure of the present invention comprises an outer blade assembly with mesh outer blades curved in arch shapes, an outer blade frame which accepts connection of the outer blade assembly in a detachable manner, and latch releases to free the outer blade assembly from the connected and latched state with the outer blade frame. The outer blade assembly is provided with latching pieces which project out from each end and lock into latching detents in the outer blade frame. The attachment structure is configured to allow separation of the outer blade assembly from the outer blade frame by pressing the latch releases which push on the outer blade assembly latching pieces dislodging the latching pieces from the outer blade frame latching detents.

Further, the electric razor outer blade assembly attachment structure of the present invention is provided with the following unique configuration. The end of each latching piece is provided with pressure arms projecting laterally from the latching piece and cut-outs below each pressure arm. Each latch release is provided with push-out projections which are located opposite each latching piece pressure arm when the outer blade case is attached to the outer blade frame. The push-out projections dislodge the latching piece pressure arms from the latching detents. In this structure, when the latch releases are pressed, the push-out projections push the latching piece pressure arms out of the latching detents freeing the latched state between the latching pieces and the latching detents. When the outer blade case moves in a direction disconnecting it from the outer blade frame, the push-out projections move to positions in the cut-outs of the latching pieces.

DETAILED DESCRIPTION OF THE INVENTION

Figure 1:
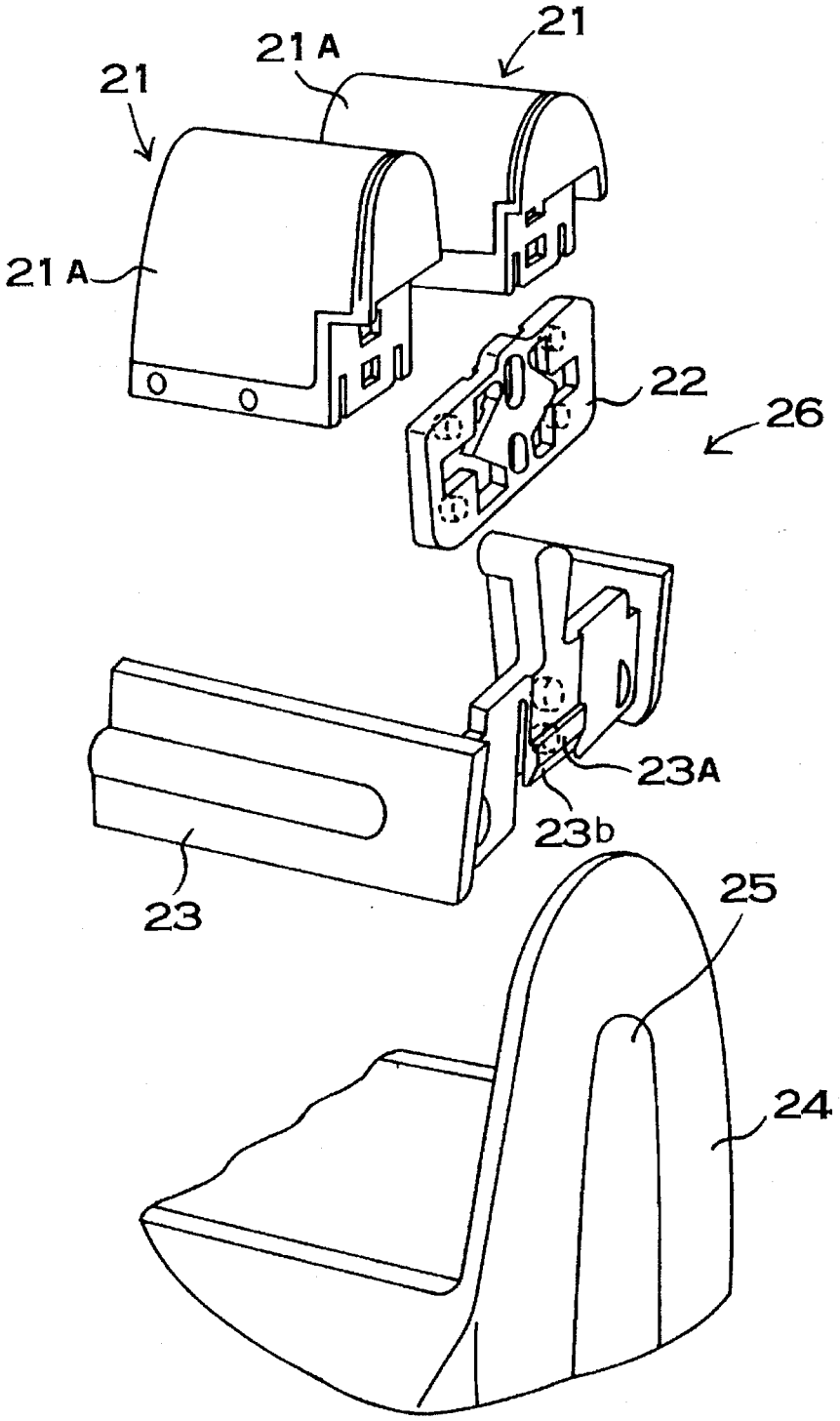
FIG. 1 is an exploded oblique view showing a prior art electric razor outer blade assembly attachment structure.

The electric razor outer blade assembly attachment structure shown in FIGS. 3 through 8 is provided with an outer blade assembly 16 and an outer blade frame 4 which connects with the outer blade assembly 16 in a detachable manner. The outer blade assembly 16 comprises three rows of outer blade units 1 and an outer blade case 3 in which the outer blade units 1 mount in a detachable manner.

The three rows of outer blade units 1 have three rows of corresponding inner blades 6 which press against the inner surfaces of the outer blades and slide back and forth in reciprocating motion. The inner blades 6 connect to a motor 7 housed within the casing 8. However, since the present invention concerns the outer blade assembly attachment structure, the mechanism for moving the inner blades in reciprocating motion and the attachment structure of the inner blades can be that of prior art electric razors or mechanisms and structures to be developed in the future.

Figure 3:
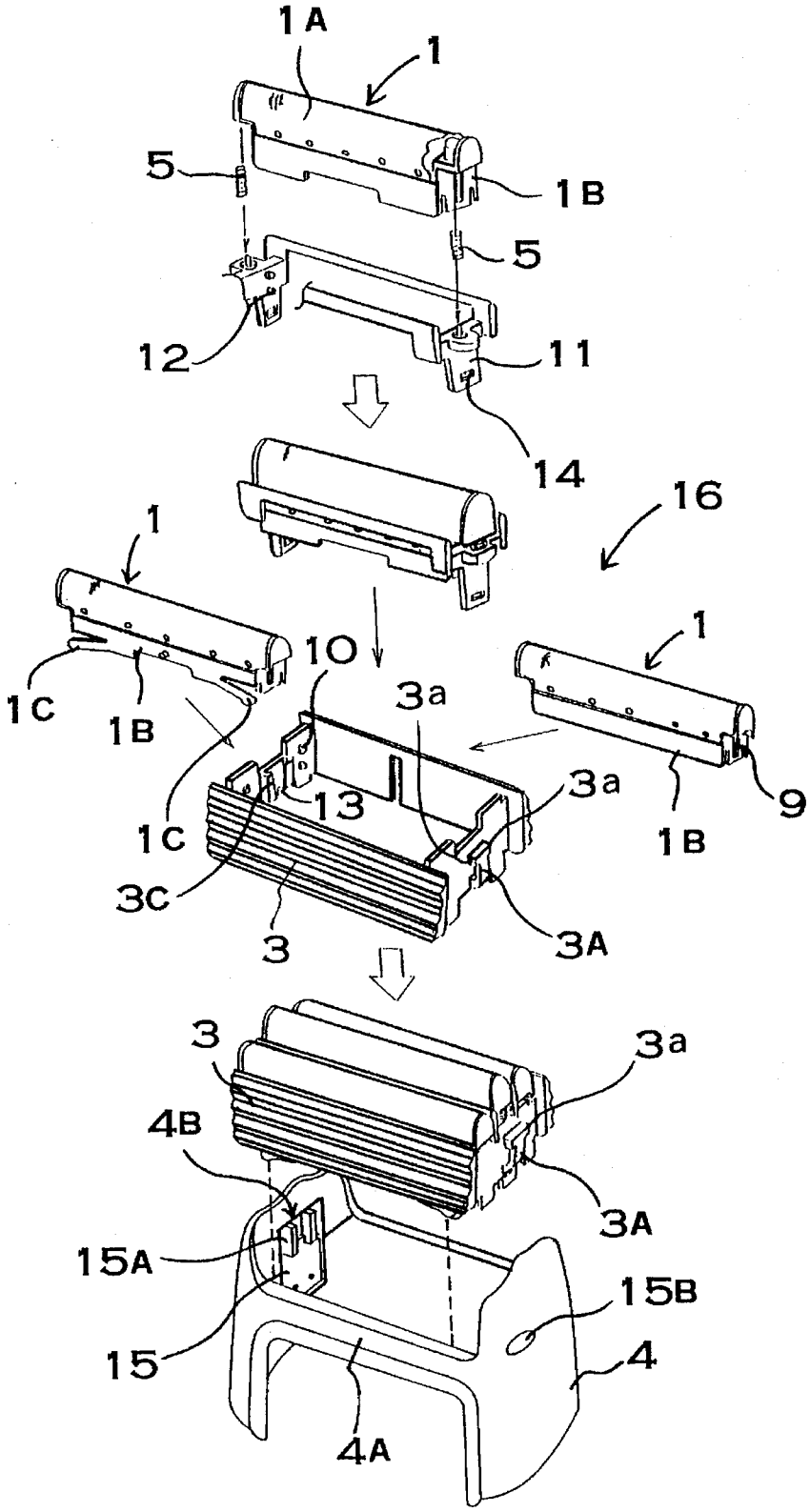
FIG. 3 is an exploded oblique view showing an embodiment of the electric razor outer blade assembly attachment structure of the present invention.
Figure 4:
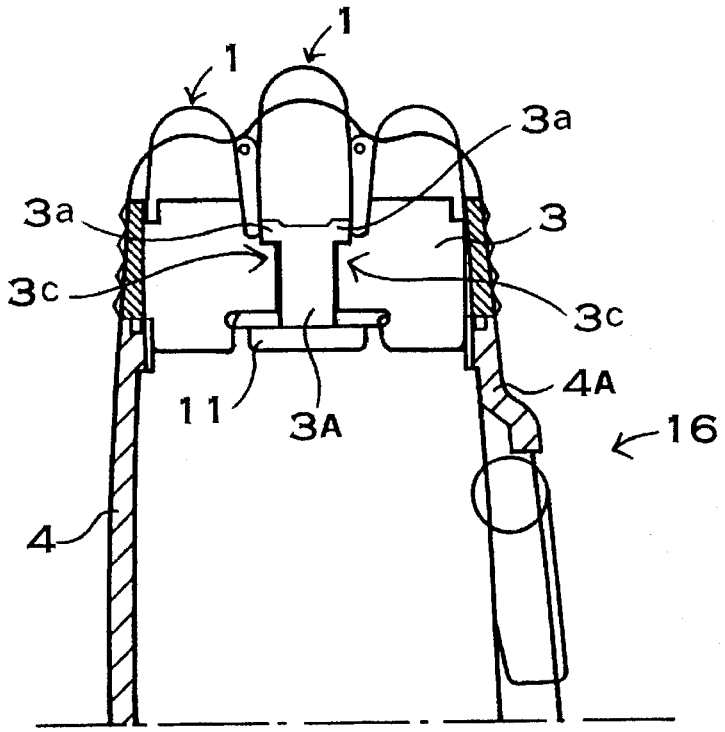
FIG. 4 is a side view in the vicinity of the outer blade case of the electric razor shown in FIG. 3.
Figure 5:
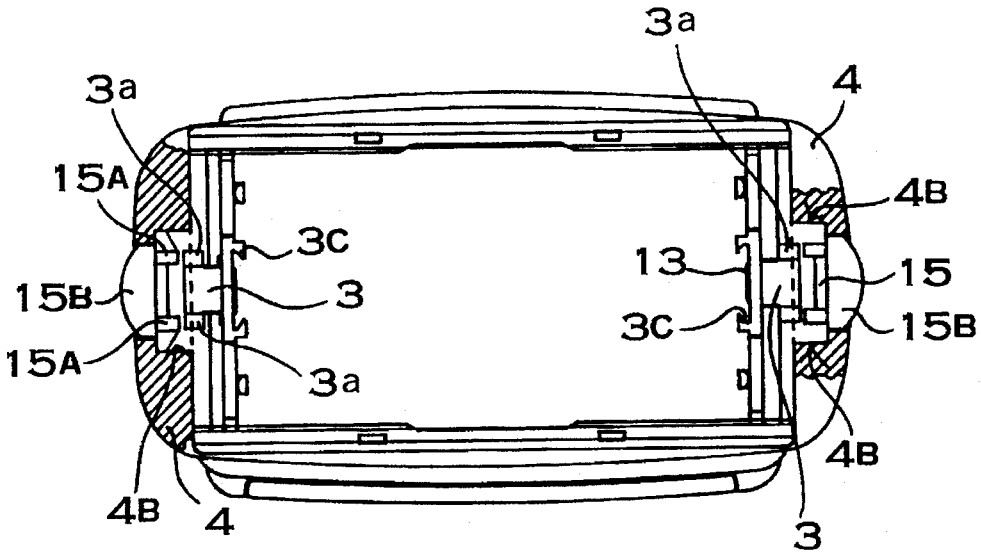
FIG. 5 is a bottom view in partial cross section of the outer blade case and the outer blade frame.
Figure 6:
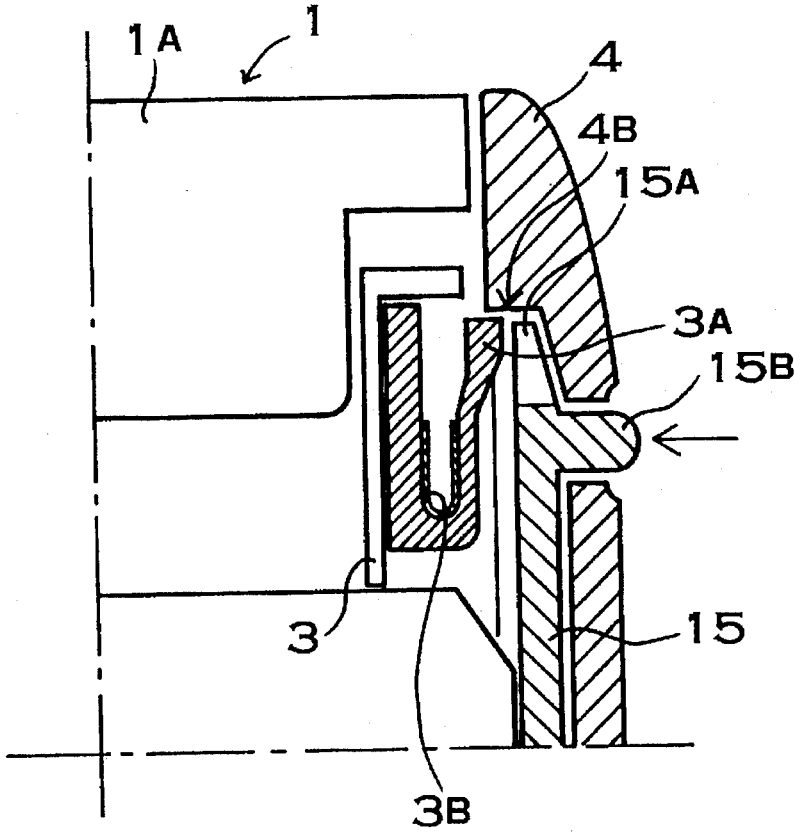
FIG. 6 is a cross section view in the vicinity of a latch release of the electric razor shown in FIG. 3.
Figure 7:
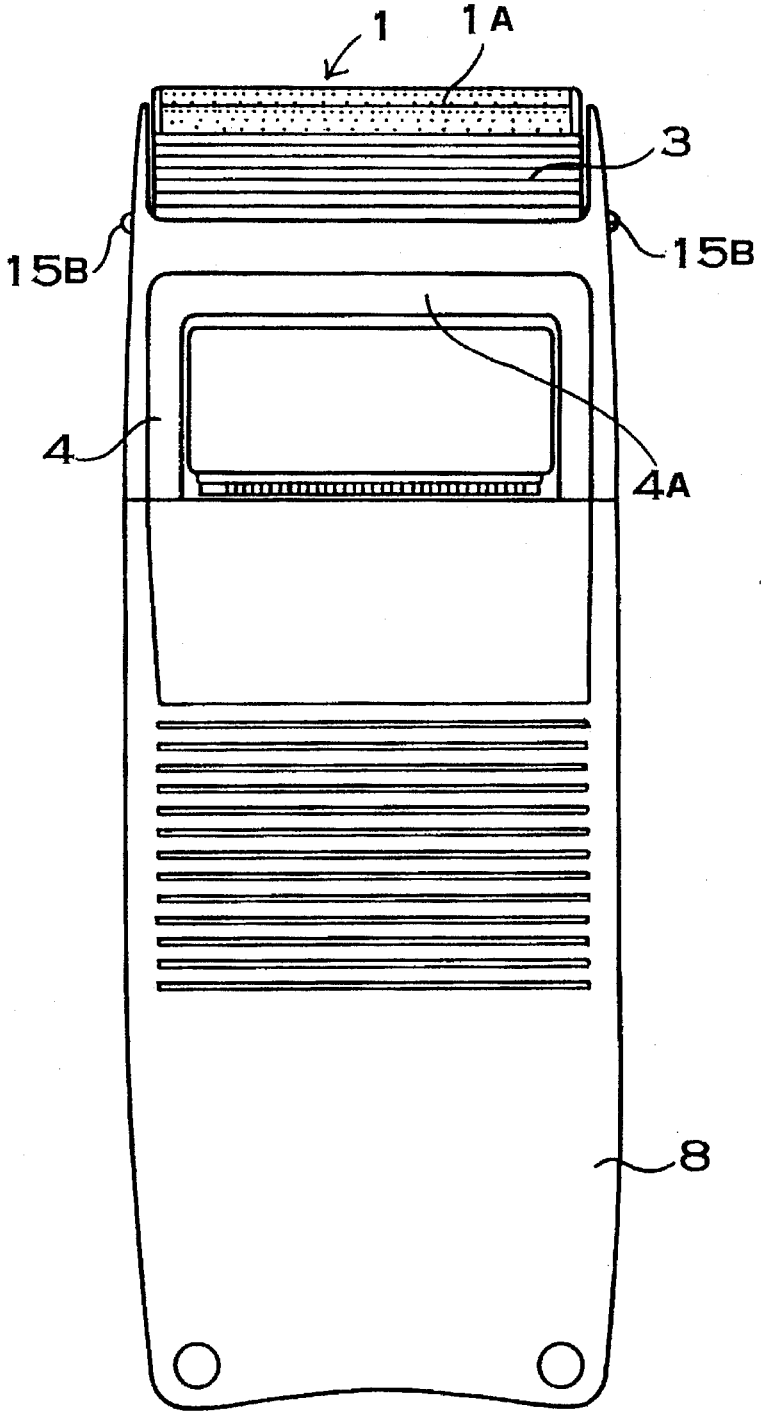
FIG. 7 is a front view showing an electric razor equipped with an embodiment of the outer blade assembly attachment structure of the present invention.
Figure 8:
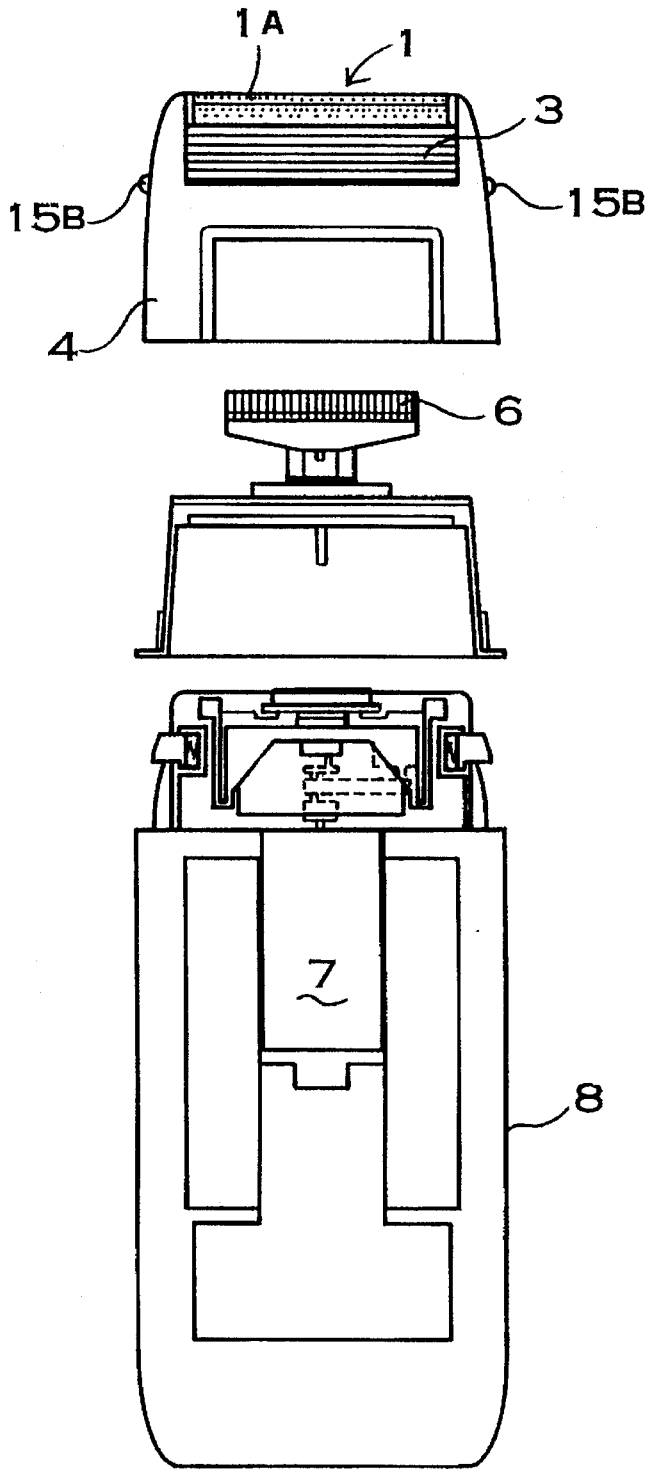
FIG. 8 is an exploded front view of the electric razor shown in FIG. 3.

The three rows of outer blade units 1 mount independently in the outer blade case 3. As shown in FIG. 3, each outer blade unit 1 comprises a plastic blade holder 1B with a mesh blade 1A affixed. The thin metal mesh blades 1A are fastened to blade holders 1B which curve in arched shapes. The blade holders 1B are made of hard plastic and formed in the shape of rectangular cylinders open at the top and bottom.

The blade holders 1B for the outer blade units 1 on either side of center are formed as a single piece with elastically deformable struts 1C projecting from both end regions of the bottom surfaces. The elastically deformable struts 1C are rod-shaped and slope downward from the center regions of the blade holders 1B towards the ends. As shown in FIG. 3, a blade holder 1B with elastically deformable struts 1C provided at each end has the characteristic that the outer blade unit 1 can be moved in a parallel fashion.

The ends of the elastically deformable struts 1C press against the upper edges 4A of the opening in the outer blade frame 4. Consequently, the elastically deformable struts 1C are positioned to project out of the bottom of the outer blade case 3 and press against the upper edges 4A of the opening in the outer blade frame 4 when the outer blade units 1 are mounted in the outer blade frame 4. The two outer blade units I on either side of an electric shaver equipped with three rows of outer blade units 1 are thereby allowed to press against the upper edges 4A of the opening in the outer blade frame 4. The two outside outer blade units 1 have their deformable struts 1C disposed only on the sides of the blade holders 1B that allow pressure on the upper edges 4A of the opening in the outer blade frame 4.

The outer blade units 1 mount in the outer blade case 3 in a manner allowing up and down movement. Therefore, vertical slits 9 are provided at both ends of the outer blade units 1. Guide projections 10 on the inside walls of the outer blade case 3 mate with the vertical slits 9. The outer blade units 1 mount in the outer blade case 3 via the vertical slits 9 and the guide projections 10 which allow them to move up and down. When the outer blade units 1 move up and down, the guide projections 10 move up and down within the vertical slits 9.

In the electric shaver with three rows of outer blade units 1 mounted in a parallel fashion in the outer blade case 3 shown in FIG. 3, the center outer blade unit 1 cannot press against the upper edges 4A of the opening in the outer blade frame 4. This is because the center blade holder 1B cannot be positioned over an upper edge 4A of a blade frame 4 side wall. The center outer blade unit 1 mounts in the outer blade case 3 in a manner allowing up and down movement via a center blade stage 11. The center outer blade unit 1 mounts in the center blade stage 11 in a manner allowing up and down movement with coil springs 5 pushing the outer blade unit 1 outward. The center blade stage 11 connects with the outer blade case 3 in a manner that does not allow up and down movement. Connection of the center outer blade unit 1 to the center blade stage 11 is by the same method that the two side outer blade units 1 mount in the outer blade case 3. Namely, vertical slits 9 are provided at both ends of the blade holders 1B, guide projections 12 which insert into the vertical slits 9 are provided on the center blade stage 11, and the guide projections 12 slide within the vertical slits 9 allowing the outer blade unit 1 to move up and down. The center blade stage 11 connects with the outer blade case 3 by insertion into connecting columns 3C provided on the inner walls of the outer blade case 3. A locking projection 13 at the lower end of each connecting column 3C catches in a locking hole 14 on the inserted center blade stage 11 to prevent disconnection of the center blade stage 11.

The outer blade assembly 16 mates with the outer blade frame 4 in a detachable fashion. The outer blade case 3 is provided with latching pieces 3A which catch in latching detents 4B to mate the outer blade assembly 16 with the outer blade frame 4 in a detachable fashion. The latching pieces 3A project out and upward from the lower portion of both ends of the outer blade case 3. The latching pieces 3A have flexible sheet metal 3B on their inner surfaces giving them the ability to elastically deform. The upper end of each latching piece 3A is provided with pressure arms **3*a* projecting laterally from both sides of the latching piece which is widened at the top giving it a T-shape. Cut-outs 3*c* are provided below each pressure arm 3*a*. As shown in the cross section of FIG. 6, outer blade frame 4 is provided with latching detents 4B which are aligned to catch the latching pieces 3A when the outer blade assembly 16 is attached. When mounting the outer blade assembly 16 on the outer blade frame 4, the latching pieces 3A slide into the latching detents 4B**.

Latch releases 15 are disposed within the outer blade frame 4 latching detents 4B to release the outer blade assembly 16 from the outer blade frame 4. Each latch release 15 is formed as a plate of flexible plastic. The lower portion of each latch release 15 is fixed to the outer blade frame 4 allowing the upper portion to deform elastically and push inward. Push-out projections 15A which push against the latching piece 3A pressure arms **3*a* are formed as a single piece at the upper end of each latch release 15. The push-out projections 15A project inward from the latch releases 15 and extend vertically in FIG. 3 in the direction of separation of the outer blade assembly 16 from the outer blade frame 4**.

Further, push buttons 15B which project out through the outer blade frame 4 are also formed as a single piece with each latch release 15. The push buttons 15B insert through holes in the outer blade frame 4 in a manner allowing them to move in and out. The push buttons 15B are pressed to disconnect the outer blade assembly 16 from the outer blade frame 4. When the push buttons 15B are pressed, the push-out projections 15A push the latching pieces 3A out of the latching detents 4B releasing the lock between the outer blade assembly 16 and the outer blade frame 4 to disconnect the outer blade assembly 16 from the outer blade frame 4.

The outer blade frame 4 has an opening to accept the outer blade assembly 16 with negligible gapping. The upper edges 4A of the side walls of the opening in the outer blade frame 4 align with the bottom edges of the outer blade units 1. The upper edge 4A width of the opening side wails is designed thick enough to allow the deformable struts 1C on the blade holders 1B to press against the side wail upper edges 4A.

The outer blade frame 4 is preferably made of metal since it is part of the shaver case. In the illustrations, the outer blade frame 4 mounts on the electric shaver body in a detachable fashion. However, it is also possible for the outer blade frame 4 to be integrated as one piece with the electric shaver body.

The electric razor outer blade assembly attachment structure shown in FIG. 3 is assembled in the following manner.

① The center outer blade unit 1 is mated to the center blade stage 11. Vertical slits 9 mate with guide projections 12 to connect the center outer blade unit 1 to the center blade stage 11.

② Both side outer blade units 1 and the center blade stage 11 with the center outer blade unit 1 connected therein are arranged in parallel and mounted in the outer blade case 3. The outer blade units 1 mount in the outer blade case 3 via the vertical slits 9 and the guide projections 10. The center blade stage 11 is inserted into connecting columns 3C.

③ The outer blade assembly 16 with the three outer blade units 1 mounted in the outer blade case 3 is inserted into the opening in the outer blade frame 4. Latching pieces 3A insert into latching detents 4B to hold the outer blade assembly 16 in the outer blade frame 4 in a manner such that it will not become inadvertently disconnected.

In this state with the outer blade units 1 mounted in the outer blade frame 4, the elastically deformable struts 1C press against the upper edges 4A of the opening in the outer blade frame 4. The outer blade units 1 are pushed flexibly upward by the opposing reaction force to the elastically deformable struts 1C pressing against the upper edges 4A of the opening side walls. Consequently, when the electric razor is used and the outer blades press against the skin, each individual outer blade unit 1 is pressed flexibly against the skin for effective shaving.

The outer blade assembly 16 attached to the outer blade frame 4 is disconnected from the outer blade frame 4 as follows.

① The push buttons 15B on the latch releases 15 are pressed.

② When the push buttons 15B are pressed, the latch releases 15 flexibly distort such that the push-out projections 15A on the upper section push inward towards the inside of the outer blade frame 4.

③ The latch release 15 push-out projections 15A push the pressure arms **3*a* at the upper extremities of the T-shaped latching pieces 3A out of the latching detents 4B**.

④ When the latching pieces 3A of the outer blade assembly 16 are pushed out of the outer blade frame 4 latching detents 4B, the outer blade assembly 16 and outer blade frame 4 become unlatched and disconnect.

⑤ When the latching pieces 3A are freed from the latching detents 4B, the outer blade assembly 16 is pushed away from the outer blade frame 4. The outer blade assembly 16 is thereby moved upward somewhat by the elastically deformable struts 1C.

⑥ When the outer blade assembly 16 has moved in the direction of disengagement from the outer blade frame 4, the push-out projections 15A on the latch releases 15 become positioned at the cut-outs **3*c* in the latching pieces 3A. When the push-out projections 15A are positioned at the cut-outs 3*c*, squeezing the latch releases 15 will not press the push-out projections 15A against the latching pieces 3A**.

⑦ The outer blade assembly 16, with no pressure applied by the latch release 15 push-out projections 15A, can be easily disconnected with light finger pressure from its position slightly projecting out of the opening in the outer blade frame 4.

Here the contact area between the latching pieces 3A and the latch releases 15 which push the latching pieces 3A out of the latching detents 4B has been made small. Therefore, compared with prior art outer blade assembly attachment structures, this outer blade assembly 16 can be pulled away from the outer blade frame 4 with light pressure. Theoretically, the frictional resistance of a pressure surface is proportional to the product of a coefficient of friction and the pressure force and is independent of the contact area. However, in actuality when the contact area between the latch releases 15 and the latching pieces 3A is reduced, the latching pieces 3A can be more easily pushed out of the latching detents 4B by the latch releases 15. This is due to the fact that the coefficient of friction between the latch releases 15 and the latching pieces 3A varies as a function of the contact area.

Further, the elastically deformable struts 1C of the outer blade assembly 16 apply pressure against the outer blade frame 4. As a result, when the latch release push buttons 15B are pressed dislodging the latching pieces 3A from the latching detents 4B, the outer blade assembly 16 moves upward. Therefore, in an outer blade assembly 16 with this structure, once the latch release push buttons 15B have been pressed, the latching pieces 3A will not catch again in the latching detents 4B even if the push buttons are released. Consequently, this outer blade assembly 16 has the characteristic that it can be easily detached. In particular, since it is not necessary to pull the outer blade assembly 16 away from the outer blade frame 4 while the latch release push buttons are being pressed, it is extremely easy to remove the outer blade assembly 16 from the outer blade frame 4.

Figure 2:
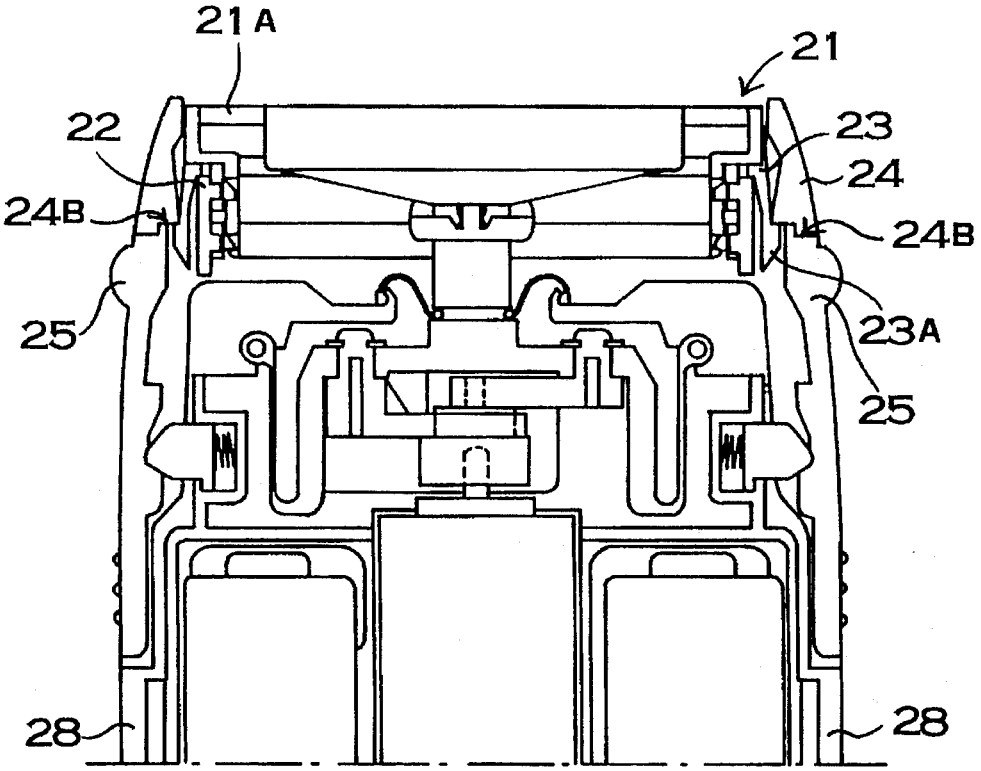
FIG. 2 is a cross sectional view showing the electric razor outer blade assembly attachment structure of FIG. 1.

In the outer blade assembly attachment structure of this invention, there is no requirement for sloping surfaces **23*b* on the latching pieces 23A to forcibly dislodge the latching pieces 23A with the latch releases 25 as in the prior art outer blade assembly 26 shown in FIGS. 1 and 2. In an electric razor in which the outer blade assembly is not forced upwards away from the outer blade frame when the latch release push buttons are pressed, the outer blade assembly must be pulled away at the same time the push buttons are pressed. Otherwise, a structure as shown in FIGS. 1 and 2 with sloping surfaces 23*b* on the latching pieces 23A is required to push the outer blade assembly 26 out with pressure from the latch releases 25 on the sloping surfaces 23*b*. An electric razor that requires pulling the outer blade assembly while the push buttons are being pressed demands that two operations be performed simultaneously and has the disadvantage that the outer blade assembly is not easily detached. Further, a configuration in which the outer blade assembly 26 is forcibly pushed out of the outer blade frame 24 by latch release 25 pressure on sloping surfaces 23*b* of the latching pieces 23A requires that the latch release push buttons 25B be pressed strongly. This is because first it is necessary to dislodge the latching pieces 23A from the latching detents 24B, and then it is necessary to strongly press the latch releases 25 against the sloping surfaces 23*b* of the latching pieces 23A** to move them upward.

In the outer blade assembly attachment structure of the present invention, the elastically deformable struts 1C, which push the outer blade units 1 outward from the outer blade case 3, apply pressure in a direction pushing the outer blade assembly 16 away from the outer blade frame 4. This allows simple disconnection of the outer blade assembly 16 from the outer blade frame 4 when the latch release push buttons 15B are pressed to dislodge the latching pieces 3A from the latching detents 4B. In other words, in this outer blade assembly attachment structure, the elastically deformable struts 1 C, which push the outer blade units 1 outward from the outer blade case 3 and against the skin, serve a dual purpose as flexible members for easily detaching the outer blade assembly 16 from the outer blade frame 4.

To detach the outer blade units 1 from the outer blade case 3, the outer blade units 1 are pulled somewhat strongly distorting the blade holders 1B and the outer blade case 3 slightly. This disconnects the outer blade case 3 guide projections 10 from the outer blade unit 1 vertical slits 9 allowing the outer blade units 1 to be pulled away from the outer blade case 3.

In the electric razor outer blade assembly attachment structure with the configuration described above, the latching pieces are dislodged from the latching detents by the latch releases, the outer blade assembly moves in a direction tending to disconnect it from the outer blade frame, and the latch release push-out projections move into cut-out regions of the latching pieces. When the outer blade assembly pulls slightly away from the outer blade frame, pressure is no longer applied to the latching pieces even when the latch releases are pressed inward. Therefore, in this outer blade assembly attachment structure, after the latch releases have been pressed and the outer blade assembly has separated slightly from the outer blade frame, it is extremely simple to detach the outer blade assembly from the outer blade frame.

Further, in the outer blade assembly attachment structure with the configuration described above, the ends of the latching pieces are widened laterally providing pressure arms which project out from the sides of the latching pieces. The laterally widened latching pieces can reliably lock into the outer blade frame latching detents. In addition, the push-out projections on the latch releases apply pressure locally on the latching piece pressure arms to dislodge the latching pieces from the latching detents. In this state, the latching pieces being dislodged by the latch releases contact the latch releases over small areas and the outer blade assembly can be separated from the outer blade frame with weak sliding forces on the pressure arms.

Finally, elastically deformable struts are provided on the outer blade units of the outer blade assembly and the outer blade units are pushed outward from the outer blade case by these elastically deformable struts. In this outer blade assembly attachment structure, the outer blade assembly is thus pushed in a direction tending to separate it from the outer blade frame due to pressure applied by the elastically deformable struts. Therefore, when the latch releases dislodge the latching pieces from the latching detents in this structure, the outer blade assembly can be easily detached from the outer blade frame with the aid of pressure from the elastically deformable struts. In particular, the deformable struts of this structure push the outer blade units outward from the outer blade frame and press the mesh blades against the skin. These elastically deformable struts also serve a dual function as flexible members for separating the outer blade assembly from the outer blade frame. Consequently, this structure has the characteristic that the outer blade assembly can be easily detached from the outer blade frame without addition of special flexible members to separate the outer blade assembly.

As this invention may be embodied in several forms without departing from the spirit and essential characteristics thereof, the present embodiment is therefore illustrative and not restrictive, since the scope of the invention is defined by the appended claims rather than by the description preceding them, and all changes that fall within the meets and bounds of the claims or equivalence of such meets and bounds thereof are therefore intended to be embraced by the claims.

What is claimed is:

1. An electric razor outer blade assembly and attachment structure, comprising:

an outer blade assembly having a first end and a second end, and including at least one outer blade unit, said at least one outer blade unit having an arch-shaped mesh blade, a first latch element projecting from said first end of said outer blade assembly and having laterally projecting pressure arms at an upper end of said first latch element, and a second latch element projecting from said second end of said outer blade assembly and having laterally projecting pressure arms at an upper end of said second latch element;

an outer blade frame having a first end and a second end, and defining an opening for receiving said outer blade assembly, said outer blade frame including a first detent formed in an inner peripheral surface of said first end of said frame and receiving said first latch element when said outer blade assembly is engaged in said frame, a second detent formed in an inner peripheral surface of said second end of said frame and receiving said second latch element when said outer blade assembly is engaged in said frame, a first latch release member extending upwardly from a lower portion of said first end of said frame and having an outwardly extending projection positioned opposite said laterally projecting pressure arms of said first latch element when said outer blade assembly is engaged in said frame, and a second latch release member extending upwardly from a lower portion of said second end of said frame and having an outwardly extending projection positioned opposite said laterally projecting pressure arms of said second latch element when said outer blade assembly is engaged in said frame; and an elastic structure provided between said outer blade assembly and said outer blade frame such that said outer blade assembly is biased in a separation direction out of said frame.

2. The electric razor outer blade assembly and attachment structure as claimed in claim 1, wherein each of said first and second latch release members is formed of an elastically deformable plastic and has a lower end which is fixed to the frame.

3. The electric razor outer blade assembly and attachment structure as claimed in claim 1, wherein each of said first and second latch release members project outwardly of said outer blade frame.

4. The electric razor outer blade assembly and attachment structure as claimed in claim 1, wherein:

said first latch release member includes a pair of push-out projections extending from an inner surface thereof so as to apply pressure to said laterally extending pressure arms of said first latch element; and said second latch release member includes a pair of push-out projections extending from an inner surface thereof so as to apply pressure to said laterally extending pressure arms of said second latch element.

5. The electric razor outer blade assembly and attachment structure as claimed in claim 1, wherein:

said first latch element has a T-shaped configuration with said laterally extending pressure arms forming the top of said T-shape; and said second latch element has a T-shaped configuration with said laterally extending pressure arms forming the top of said T-shape.

6. The electric razor outer blade assembly and attachment structure as claimed in claim 1, wherein:

said outer blade assembly includes an outer case; and said at least one outer blade unit is mounted in said outer case such that said at least one outer blade unit can move upward and downward relative to said outer case.

7. The electric razor outer blade assembly and attachment structure as claimed in claim 6, wherein said first and second latch elements and said outer case are formed of a plastic material in a single piece.

8. The electric razor outer blade assembly and attachment structure as claimed in claim 7, wherein each of said first and second latch elements include a U-shaped flexible metal element.

9. The electric razor outer blade assembly and attachment structure as claimed in claim 6, wherein said at least one outer blade unit includes a plastic holder fixed to said mesh blade, said plastic holder having integrally formed elastically deformable struts which engage said outer blade frame and bias said outer blade assembly away from said outer blade frame.

10. The electric razor outer blade assembly and attachment structure as claimed in claim 9, wherein said elastically deformable struts are inclined relative to a bottom surface of said plastic holder.

11. The electric razor outer blade assembly and attachment structure as claimed in claim 9, wherein said elastically deformable struts extend from a central bottom portion of said plastic holder toward opposite ends of said plastic holder.

12. The electric razor outer blade assembly and attachment structure as claimed in claim 9, wherein said at least one outer blade unit comprises a plurality of outer blade units arranged in a parallel fashion in said outer blade case, and said plurality of outer blade units positioned adjacent opposite sides of said outer blade case have plastic holders each provided with elastically deformable struts.

* * * * *